US009573739B2

(12) United States Patent
Torrent Ortega

(10) Patent No.: US 9,573,739 B2
(45) Date of Patent: Feb. 21, 2017

(54) STRUCTRUAL ELEMENT FOR A BOTTLE CLOSURE WITH MEANS FOR SHOWING ITS FIRST USE IN NOMINAL CONDITIONS

(71) Applicant: COMPAÑIA DE TAPONES IRRELLENABLES, S.A., Puerto de Santa María-Cádiz (ES)

(72) Inventor: David Torrent Ortega, Puerto de Santa María-Cádiz (ES)

(73) Assignee: COMPAÑIA DE TAPONES IRRELLENABLES, S.A., Puerto de Santa María-Cádiz (ES)

( * ) Notice: Subject to any disclaimer, the term of this patent is extended or adjusted under 35 U.S.C. 154(b) by 0 days.

(21) Appl. No.: 14/437,226

(22) PCT Filed: Oct. 22, 2013

(86) PCT No.: PCT/EP2013/072080
§ 371 (c)(1),
(2) Date: Apr. 21, 2015

(87) PCT Pub. No.: WO2014/064110
PCT Pub. Date: May 1, 2014

(65) Prior Publication Data

US 2015/0274387 A1 Oct. 1, 2015

(30) Foreign Application Priority Data

Oct. 22, 2012 (EP) ..... 12382409

(51) Int. Cl.
*B65D 41/00* (2006.01)
*B65D 47/36* (2006.01)
(Continued)

(52) U.S. Cl.
CPC ..... *B65D 47/36* (2013.01); *B65D 41/3438* (2013.01); *B65D 47/043* (2013.01); *B65D 47/106* (2013.01); *B65D 2101/0023* (2013.01)

(58) Field of Classification Search
CPC .... B65D 2101/0023; B65D 2101/0084; B65D 47/043; B65D 47/103; B65D 47/106; B65D 47/3438; B65D 47/36
See application file for complete search history.

(56) References Cited

U.S. PATENT DOCUMENTS 4,531,657 A * 7/1985 Saito ..... B65D 47/103 222/108
4,664,295 A * 5/1987 Iida ..... B29C 45/44 220/270
(Continued)

FOREIGN PATENT DOCUMENTS

WO 2009022892 A1 2/2009
WO 2010125595 A1 11/2010

OTHER PUBLICATIONS

International Search Report and Written Opinion for related International Application PCT/EP2013/072080 dated Dec. 11, 2013.

*Primary Examiner* — Fenn Mathew
*Assistant Examiner* — Don M Anderson
(74) *Attorney, Agent, or Firm* — Tristan A. Fuierer; Moore & Van Allen, PLLC

(57) ABSTRACT

A structural element for a bottle closure having means for showing a first use in nominal conditions. This structural element can be made from components such as a pouring dispenser or a frame. This structural element is characterized by the use of two components which are linked such that the attachment between both disappears after the first use in nominal conditions when said structural element is mounted in the operating mode on the bottle. The first use in nominal
(Continued)

conditions requires removing one of the components and it cannot be put back in its original position, restoring its also original attachment.

15 Claims, 5 Drawing Sheets

(51) Int. Cl.

| | |
|---|---|
| ***B65D 47/04*** | (2006.01) |
| ***B65D 47/10*** | (2006.01) |
| ***B65D 41/34*** | (2006.01) |

(56) References Cited

U.S. PATENT DOCUMENTS

| | | | | |
|---|---|---|---|---|
| 5,785,209 | A * | 7/1998 | Guglielmini | B65D 47/043 222/153.07 |
| 2008/0054027 | A1* | 3/2008 | Skillin | B65D 47/0828 222/547 |
| 2009/0289027 | A1* | 11/2009 | Torrent Ortega | B65D 41/348 215/352 |
| 2010/0122991 | A1* | 5/2010 | Taguchi | B65D 47/106 222/83 |
| 2010/0264144 | A1* | 10/2010 | Nusbaum | B65D 47/0861 220/258.2 |
| 2011/0056904 | A1* | 3/2011 | Rozenberg | B65D 41/3457 215/201 |

* cited by examiner

10

1.1.1
1.4
X-X'
C1
1.3
1.5
1.6
1.9
1.1
1.8
1.7
C2
1.2
1

STRUCTRUAL ELEMENT FOR A BOTTLE CLOSURE WITH MEANS FOR SHOWING ITS FIRST USE IN NOMINAL CONDITIONS

CROSS-REFERENCE TO RELATED APPLICATIONS

This application is filed under the provisions of 35 U.S.C. §371 and claims the priority of International Patent Application No. PCT/EP2013/072080 filed on 22 Oct. 2013 entitled "STRUCTURAL ELEMENT FOR A BOTTLE CLOSURE WITH MEANS FOR SHOWING ITS FIRST USE IN NOMINAL CONDITIONS" in the name of David TORRENT ORTEGA, which claims priority to European Patent Application No. 12382409.6 filed on 22 Oct. 2012, both of which are hereby incorporated by reference herein in their entirety.

OBJECT OF THE INVENTION

The present invention relates to a structural element for a bottle closure having means for showing a first use in nominal conditions. This structural element can be made from components such as a pouring dispenser or a frame.

This structural element is characterised by the use of two components which are linked such that the attachment between both disappears after the first use in nominal conditions when said structural element is mounted in the operating mode on the bottle. The first use in nominal conditions requires removing one of the components and it cannot be put back in its original position, restoring its also original attachment.

BACKGROUND OF THE INVENTION

Closures with means for preventing the fraudulent refilling or manipulation of the contents of bottles are of great interest in the marketing of expensive beverages. This is the case of liquors although it is not the only case.

There are many means for showing a first use of a bottle closure such that the closure shows certain features before being opened for the first time and other features after being opened for the first time. Specific features modified in the first opening are those showing that the closure has been opened for the first time.

The means for showing the first opening can be of a different nature. For example, there are closures which make use of breakable bridges attaching two parts which are separated after the closure is opened for the first time. One of these parts can be a ring, for example, which detaches leaving part of the closure previously inaccessible visually exposed.

If the part which is exposed after the first opening has another colour, the evidence of said first opening visually stands out in a more striking way.

The changes a closure undergoes for showing the first opening do not necessarily have to be visual but they can make use of other senses. For example they can be sonorous. This is the case when there are elements fixed by means of a type of fastening which after the first opening can have a looseness causing the closure to make a sound or make a different sound when it is moved even though they can continue to be housed in a specific cavity for example.

These known elements do not allow a first use in conditions other than nominal conditions. An example is allowing the liquid to exit the bottle with a lower flow rate to provide a sample, or with a manner of pouring which clearly should not be offered in nominal conditions. In these cases the means of evidence must allow showing that the closure has already been used in nominal conditions and, if necessary, accepting designs allowing use in other conditions.

The present invention is a structural element which allows solving the aforementioned problem by means of a specific configuration and combination of components.

DESCRIPTION OF THE INVENTION

The invention consists of a structural element intended for being in a bottle closure. The structural element can be a pouring dispenser, such as that which will be shown below in the examples used for describing the invention, or it can also be a frame incorporating a pouring dispenser for example.

The term "nominal conditions" will be used throughout the description. These nominal conditions are the ordinary use conditions of the closure or the conditions in which it is possible to pour the liquid stored in the bottle according to conditions established at the time of designing the closure. For example, the set of conduits and windows existing in a closure with means for preventing fraudulent refilling can impose a flow rate, an outward flow mode, or even a specific sound when the bottle comprising the closure is shaken.

The closure according to the invention could allow pouring with a flow rate other than that established as nominal, and this flow rate could be modified when the element showing the first use giving rise to a flow rate in said nominal conditions is removed; or when the element showing the first use is removed it would go from preventing the flow in some passage windows for the fluid to allowing said passage in its entirety; or when the element showing the first use is removed it would modify the sound of an element which makes a sound when the bottle containing the closure is shaken. These are only illustrative examples comparing two states, the state corresponding to a use in non-nominal conditions and another state in nominal conditions.

The invention solves the problem of providing these two states, before and after a first use in nominal conditions, providing a structural element for a bottle closure with means for showing its first use in nominal conditions, where this structural element extends along a longitudinal X-X' axis corresponding to the axis of the mouth of the bottle when the structural element is in an operating position on said mouth.

- The X-X' axis is the axis which allows establishing mates between the different components comprising the device of the invention and the bottle. The bottle is formed by a container and a mouth. The device object of the invention is intended for being installed on the mouth of the bottle, either directly or by means of the interposition of another intermediate component.
- The latter is the case of an embodiment of great interest in which the structural element is a pouring dispenser and is located on a frame which in turn is located on the mouth of the bottle.
- When it is indicated that the structural element of the invention is in the operating mode on the mouth of the bottle, it is understood that said structural element is installed in its definitive position on the mouth of the bottle, i.e., in the position for which it is designed.

The structural element comprises two components,

- the first component comprises:
  - an outer sleeve, with an axis parallel to the X-X' axis, having a base at one of its ends suitable for being coupled on the mouth of the bottle a core arranged inside the outer sleeve, with its axis essentially parallel to the X-X' axis, and linked to it by means of at least one bridge, where there is a first cavity between the core and the outer sleeve accessible from the outside when the structural element is in the operating position on the mouth of the bottle; and a second cavity accessible from the inside, the first cavity and the second cavity are communicated by means of one or more windows intended for the passage of the liquid stored in the bottle when the structural element is in the operating position on the mouth of the bottle.

This first component is intended for remaining linked to said bottle once the structural element is installed on the mouth of the bottle. In other words, the change which it shows before and after the first use in nominal conditions is the removal of the second component the features of which are described below.

This first component has two parts, an outer sleeve and a core. Both have their axes parallel to the X-X' axis and the core is located inside the sleeve. The preferred ways of carrying out the invention not only provide for arranging the axes of the outer sleeve and of the core parallel but they are coinciding, i.e., coaxial. This configuration limits the passage of the liquid contained in the bottle during pouring to the space existing between both parts when the structural element is in the operating position on the mouth of the bottle.

Both parts are structurally joined together integrally by means of the existence of at least one bridge. The existence of attachment bridges between the core and the outer sleeve gives rise to windows.

The existence of two cavities, an outer cavity and therefore accessible by the user, and another inner cavity accessible from the inside, i.e., it is not accessible by the user in normal use conditions when it is in the operating position on the mouth of the bottle, is also relevant.

The second component, which can be removed by the user so that the structural element operates in nominal conditions, comprises:

a first body arranged in the first cavity, a gripping element accessible from the outside in an operating position attached to the first body, an element of the first body having a mechanical link or attachment with the first component and is suitable so that after the second component is removed by the user by means of pulling on the gripping element, this mechanical link or attachment stops acting.

The second component is the component that the user removes to enable allowing the bottle to offer nominal use conditions. For example, the first body arranged in the first cavity can be a body completely or partially covering the windows existing in the first component. The fluid exiting through the windows is thereby obstructed or blocked in its entirety according as the case may be. The removal of the second component in this example provides nominal use conditions in which the windows are completely open and without an obstacle obstructing the outflow.

This element can be easily removed since it has a gripping element which is accessible by the user. Although it is said that it is accessible from the outside in an operating position, when the closure has a cap covering said structural element in addition to the structural element, it must be interpreted that the outside is the identifiable location when the cap or any additional element covering the structural element has been removed.

Moreover, if the structural element is made as a pouring dispenser by way of example, the closure can be completed by a cap covering the pouring dispenser or even a capsule covering the cap and therefore also the structural element. A first opening will require removing the capsule, removing the cap, and the pouring dispenser will thus be exposed (in this embodiment the first component). The outside will correspond to the space accessible by the user, for example the upper part where it is easy to remove with one's fingers a small gripping element which is what allows removing the second component.

Outside is therefore opposite to inside, where the latter is the space demarcated by the passage from the first cavity to the second cavity arranged internally and in communication with the inside of the bottle when the structural element is in the operating position on the mouth of the bottle.

Lastly, this second component is linked to the first component by means of a mechanical attachment. This mechanical attachment is what disappears when the second component is removed for the first time.

Those embodiments in which the mechanical attachment is arranged in a location of the second cavity are especially advantageous because they make manipulation in order to return the attachment to this location again impossible since it is located in a place which is inaccessible by the user.

Those embodiments in which the first component and the second component are obtained by means of co-injection or by means of over injection are also especially advantageous because the injection of the second component on the first component allows obtaining this attachment due to the partial melting of the interface between the materials of both components. With this attachment, the restoration is not possible if at least one of the materials does not melt. During manufacture, the molten material is housed by a mould limiting the flow of the molten material and where said mould additionally has access both to the outer cavity and to the inner cavity. The fraudulent manipulation which gives rise to the attachment by the partial melting of at least one of the components as occurs in over injection or in co-injection is not possible for this reason.

DESCRIPTION OF THE DRAWINGS

These and other features and advantages of the invention will be more clearly understood from the following detailed description of a preferred embodiment given only by way of illustrative and non-limiting example, with reference to attached drawings.

DETAILED DESCRIPTION OF THE INVENTION

Figure 1:
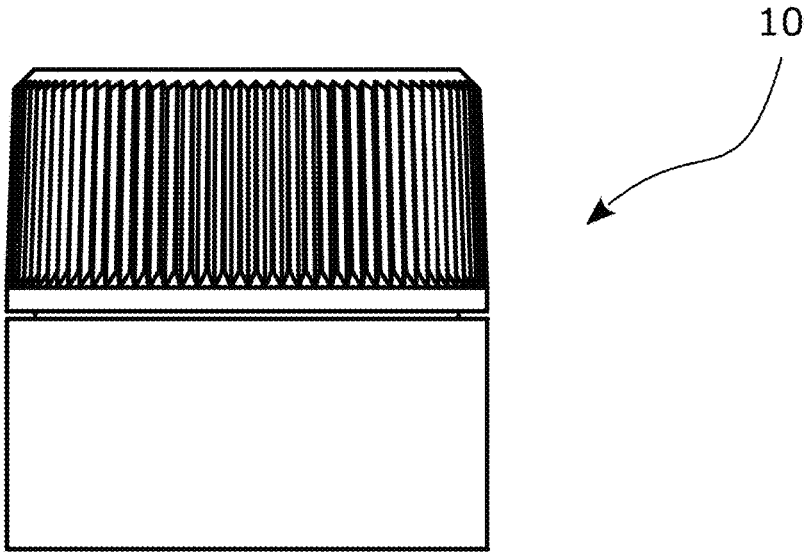
FIG. 1 shows a first embodiment where the structural element is a pouring dispenser body. This same figure shows a section according to a vertical plane of the so-called first component (the pouring dispenser), without showing the second component in order to see the details of the inner structure of the first component more clearly.
Figure 1:
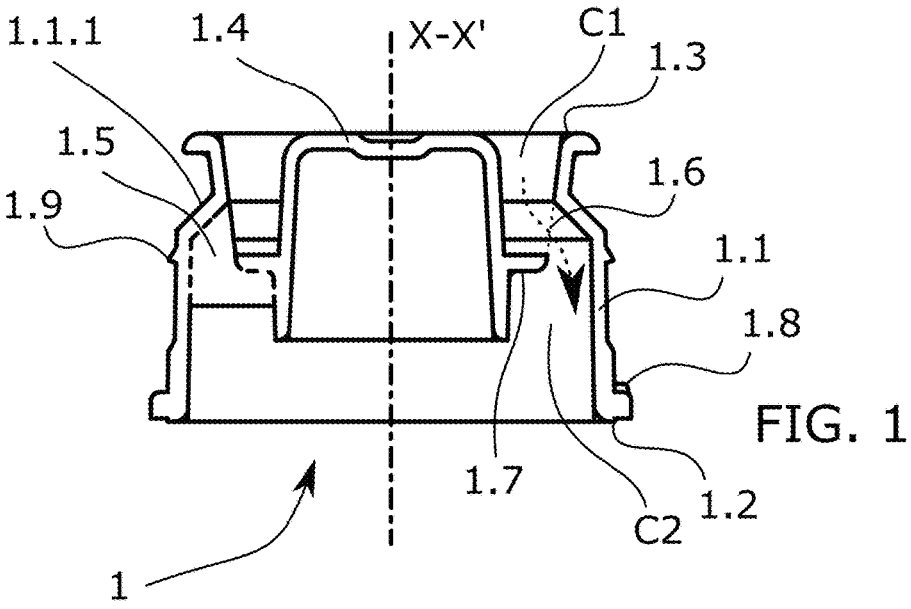
Figure 2:
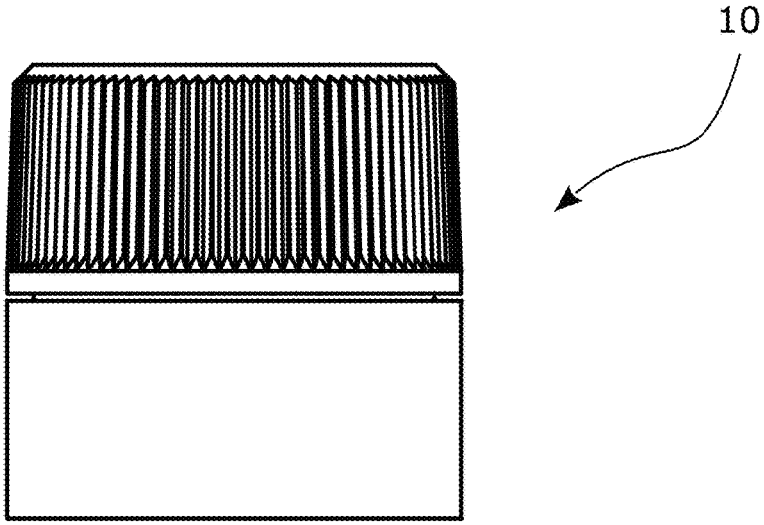
FIG. 2 shows a section according to a vertical plane of the first component and the second component according to the first embodiment. This second component is what allows showing the first use in nominal conditions once it is removed.
Figure 2:
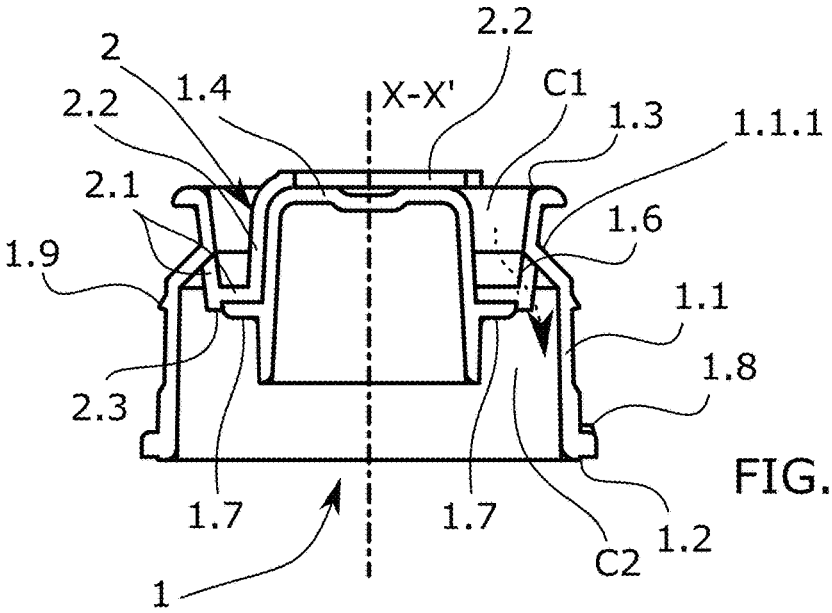

According to the first inventive aspect, the present invention is a structural element for a bottle closure which allows showing its first use in nominal conditions. FIGS. 1 and 2 show a first embodiment where the structural element is a pouring dispenser. The structural element of this embodiment is particularly suitable for being coupled on a frame having a valve for preventing fraudulent refilling of the bottle on which it is coupled. This frame is arranged directly on the bottle in this particular case. In other embodiments of the invention, it is possible for the structural element to be arranged directly on the bottle. In both cases, when it is indicated that the structural element is in the operating mode on the mouth of the bottle, it is understood as that it is so directly or with the interposition of other elements as is the case of this embodiment.

FIG. 1 only shows the first component (1) of the structural element such that there are no regions concealed by the graphical depiction of the second component (2). According to the first embodiment, this first component (1) is formed by an essentially cylindrical outer sleeve (1.1). The outer sleeve (1.1) has a base (1.2) serving as a support on a perimetric ring of the frame which in turn rests directly on the mouth of the bottle. The frame is also not depicted in the figure for the sake of clarity.

A thicknessing on which there are arranged teeth (1.8) which allow improving the fixing of the structural element to the bottle with the collaboration of elements of the closure which are not object of this invention is shown in this base (1.2).

There is a thread (1.9) on the outer surface of the outer sleeve (1.1) for screwing a cap (10) on. The cap (10) is what establishes the closure to prevent the liquid from exiting.

This same outer sleeve (1.1) shows a section reduction (1.1.1) giving rise to a sector in its upper part having a smaller diameter which in turn ends in a pouring surface (1.3).

A core (1.4) is housed inside the outer sleeve (1.1). In this embodiment the core (1.4) is formed by a body in the form of an inverted cup, giving rise to an internal cavity which allows housing a valve for preventing fraudulent refilling.

Like the outer sleeve (1.1), this core (1.4) also has an axis of symmetry where both axes are coaxial and coinciding with the longitudinal X-X' axis defined by the mouth of the bottle.

The core (1.4) and the outer sleeve (1.1) are linked by a plurality of fin-shaped bridges (1.5). The cross-section selected in FIG. 1 coincides on the left side of the first component with one of the bridges (1.5). In the remaining figures the vertical section plane which gives rise to the different sections has not been made to coincide with any of the bridges (1.5) although these exist to clearly show the passage channels for the fluid.

Dotted lines coinciding with the section of the core (1.4) and the outer sleeve (1.1) have been used in the view of FIG. 1, where the wing-shaped bridge (1.5) is shown, although the intersection resulting from the attachment with the core (1.4) and the attachment with the outer sleeve (1.1) should not give rise to any line. These dotted lines allow clearly identifying, for example, the area of the bridge (1.5) which is in contact with the fluid during pouring.

In this embodiment, the core (1.4) additionally has a perimetric ring (1.7). FIG. 1 shows how a first cavity (C1), which is accessible by the user, and a second cavity (C2), which is not accessible by the user, are configured between the core (1.4) and the outer sleeve (1.1). In this embodiment, the separation between the first cavity (C1) and the second cavity (C2) is defined by the passage partially restricted by means of the narrowing of the outer sleeve (1.1), the free edge of the bridge (1.5) giving access to the first cavity (C1) and the ring (1.7) of the core (1.4). These elements define the windows (1.6) allowing the passage between the first cavity (C1) and the second cavity (C2).

When pouring the bottle, the liquid passes through these windows (1.6) from the second cavity (C2), with access to the content of the bottle, to the first cavity (C1), which in turn flows into the pouring surface (1.3).

This access passage (in the opposite direction) from a first cavity (C1) to a second cavity (C2) has also been identified by means of an arrow with a dotted line.

The same first component (1) as in FIG. 1 is depicted in FIG. 2 except that the section does not include the bridge (1.5) and the second component (2) is shown incorporated.

In this embodiment the second component (2) has a first body (2.1) in the form of a perimetric ring resting on the ring (1.7) protruding also perimetrically from the core (1.4). In turn, this first body (2.1) is covering the windows (1.6) of the first component preventing the liquid from exiting the bottle.

It is possible for the liquid to exit the bottle only when the second component (2) is removed. According to another embodiment, the first body (2.1) of the second component (2) only covers some of the windows (1.6) or partially covers them, allowing a small amount of liquid to exit but not in nominal conditions.

The removal of this second component (2) gives rise to a configuration of the structural element such as that shown in FIG. 1 where it is possible for the liquid to exit in nominal conditions.

In this embodiment, the first body (2.1) of the second component (2) shows an element (2.3) projecting towards the second cavity (C2) resting on the perimetric edge of the ring (1.7) of the core (1.4).

Although the converging form of this element (2.3) can give rise to a specific retention or mechanical link taking into account the section on each side of the longitudinal X-X' axis, in this embodiment the structural element has been manufactured in two steps, a first step of plastic injection giving rise to the first component shown in FIG. 1 and a second step of plastic over injection, with a plastic which can be different from the first, providing the second component on the first component. The contact region of the first body (2.1) of the second component (2) on the first component (1) is attached by the partial melting of the plastic in the interface. Both mechanical attachments are attachments linking the second component (2) to the first component (1).

The second component (2) further shows a gripping element (2.2) extending from the base of the first body (2.1) located on the perimetric ring (1.7) of the core (1.4) to the upper part of the core (1.4). This upper zone of the core (1.4) is the most easily accessible by the user therefore it is easy to grab the gripping element (2.2) with one's fingers and pull it.

Achieving a weak attachment in this upper zone of the core (1.4) is possible in the over injection operation such that the gripping element (2.2) is held tight to the core (1.4) until the user breaks the weak attachment with a finger for example.

The user pulling on the gripping element (2.2) allows the second component (2) to be removed, overcoming the mechanical link or links it maintains with the first component (1). Once these links have stopped acting they can no longer be restored so the first use in nominal conditions is shown.

Figure 3:
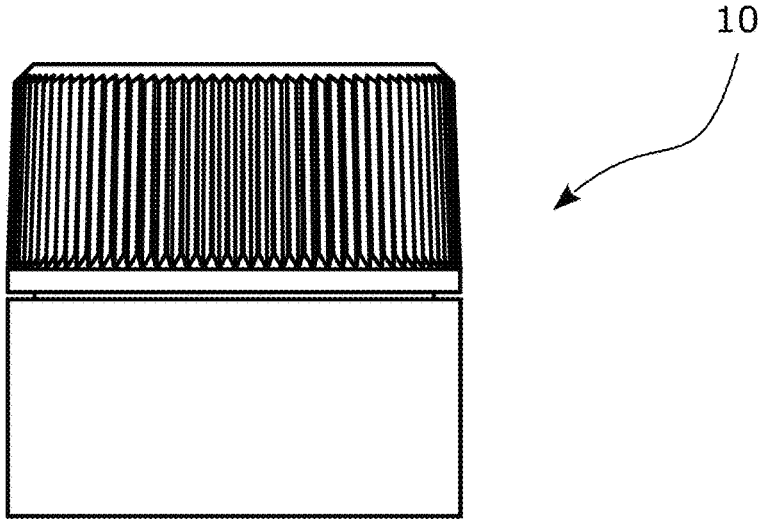
FIG. 3 shows a section according to a vertical plane of the first component and the second component according to a second embodiment.
Figure 3:
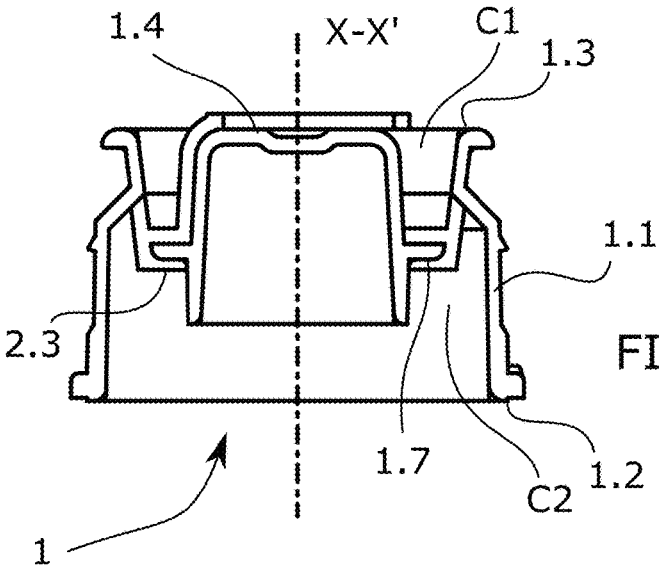

FIG. 3 shows a second embodiment where the element (2.3) of the first body (2.1) with a mechanical link extends below the ring (1.7) of the core (1.4). This location of the second cavity (C2) is even more inaccessible by the user and allows a stronger mechanical link between the second component (2) and the first component (1). Although the attachment by over injection is not strong, the shape the second component (2) adopts for resting on the lower surface of the ring (1.7) increases the tensile strength and above all makes returning the second component (2) in the first component (1) difficult.

Figure 4:
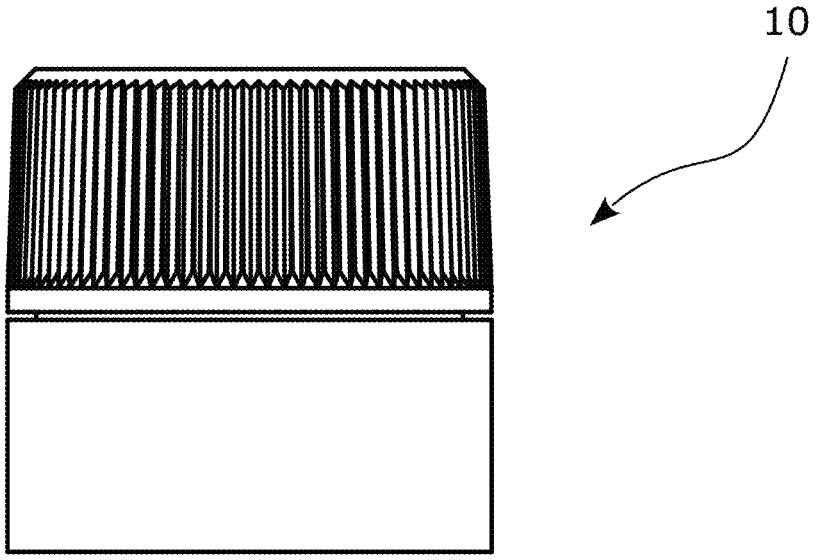
FIG. 4 shows a section according to a vertical plane of the first component and the second component according to a third embodiment.
Figure 4:
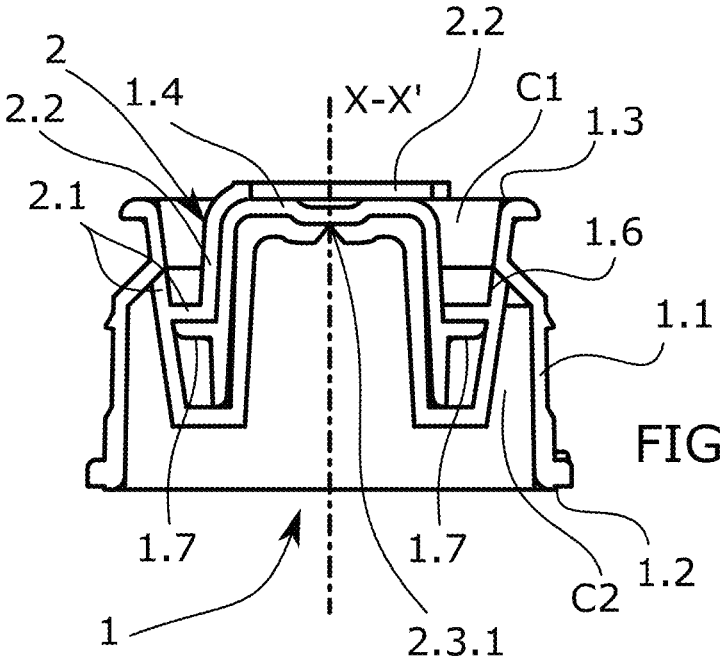

FIG. 4 shows a third embodiment where the element (2.3) of the first body (2.1) with a mechanical link extends in the lower part until it reaches the lower part of the core (1.4) entering the internal cavity of said core (1.4).

This solution can be combined with the preceding example since it is possible to additionally arrange a support on the ring (1.7) of the core (1.4).

In this example shown in FIG. 4 the extension of the element (2.3) of the first body (2.1) interferes with any component which is housed in the internal cavity of the core (1.4), in particular the components of the valve.

The components of the valve are movable components which in a specific position allow the liquid to pass and in another position close the passage for the liquid. The existence of an element (2.3) which obstructs the movement of the movable component of the valve before the second component (2) is removed and which disappears after being removed makes this movable element have a different degree of freedom before and after the second component (2) is removed. As a result, this embodiment not only provides visual evidence and evidence of a change in the interaction with the fluid by modifying the openings in the windows (1.6) but also sonorous evidence since the free movement of the movable components make sound and the complete or partial release thereof changes the conditions in which said sound is made.

A particular case of this example is when the element (2.3) obstructing the movement of the movable component of the valve completely blocks its mobility.

In order to facilitate the removal of the second component by the user, this element (2.3) of the first body (2.1) can have one or more breakable bridges (2.3.1), i.e., weakened attachments which give way to stress.

Figure 5:
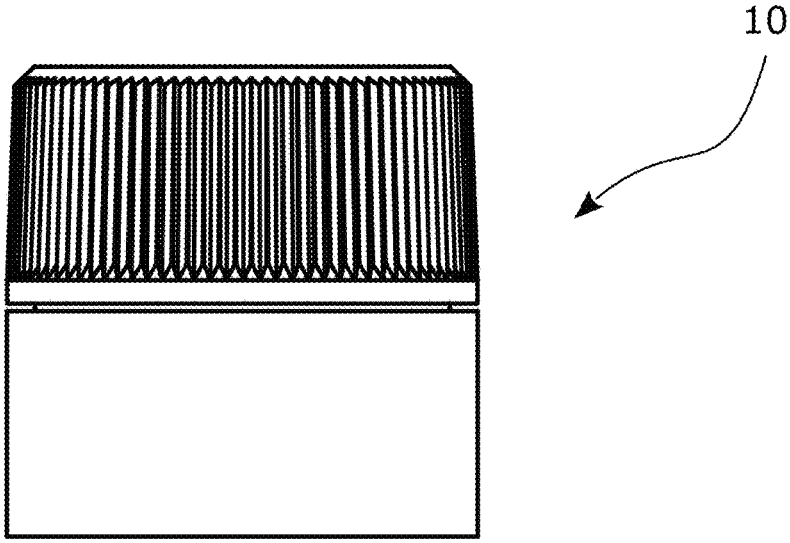
FIG. 5 shows a section according to a vertical plane of the first component and the second component according to a fourth embodiment.
Figure 5:
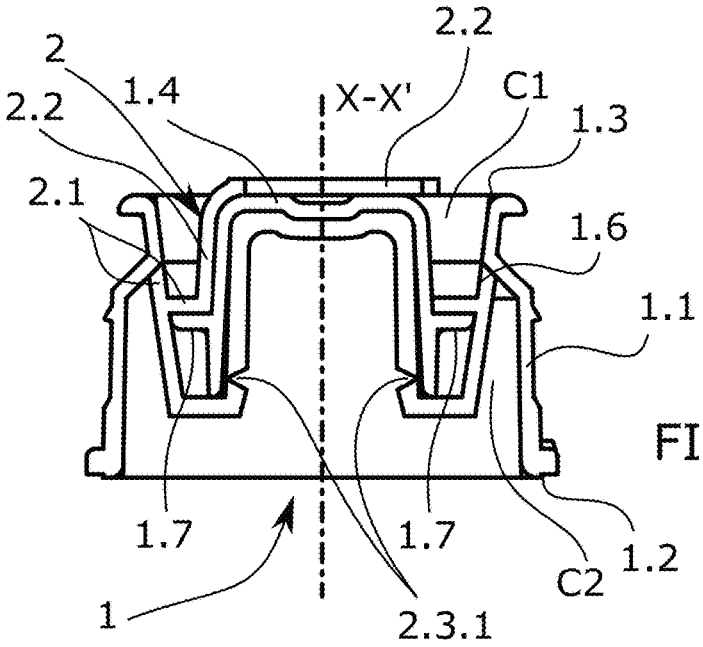

FIG. 5 shows another embodiment where there are now two breakable bridges (2.3.1) and they are arranged at the lower ends of the prolongation housed inside the cavity of the core (1.4). This can give rise to two different situations, as appropriate, an embodiment in which the sector housed in the cavity of the core (1.4) has an attachment keeping it attached to the core (1.4) after the second component (2) is removed, and another situation in which this prolongation is not linked to the core (1.4) after it is removed. In turn, this second situation gives rise to two particular examples, one in which the sector which breaks by either breakable bridge is kept attached to the first body (2.1) and is extracted with it, and another in which this sector falls inside the bottle.

Any of these examples can be combined since the particular solutions establishing a link between the first component (1) and the second component (2) do not have to be incompatible, and a person skilled in the art would be capable of using two simultaneous modes of mechanical attachments on the same structural element.

An object of the invention is also a closure incorporating a structural element such as that described as well as a cap.

An object of the invention is also a closure such as the preceding closure where the cap (10) has at least one transparent surface covering the zone of the core (1.4), the first cavity (C1) or both. Even though the cap (10) is placed on the bottle, the user can view the second component (2) or part of said component (2) because the surface is transparent.

Since the user can view the second component (2) or part of said component (2) without needing to remove the cap, the user does not need to unscrew it to check if the bottle has been used for the first time in nominal conditions.

According to a further embodiment, the second component is attached to the first component (1) closing any communicating passage between the first cavity (C1) and the second cavity (C2) sealing the bottle when the structural element is closing its mouth.

The invention claimed is:

1. A structural element for a bottle closure with means for showing its first use in nominal conditions, where this structural element extends along a longitudinal X-X' axis corresponding to the axis of the mouth of the bottle when the structural element is in an operating position on said mouth and comprises two components, a first component (1) comprising:

an outer sleeve (1.1), with an axis parallel to the X-X' axis, having a base (1.2) at one of its ends suitable for being coupled on the mouth of the bottle a core (1.4) arranged inside the outer sleeve (1.1), with its axis essentially parallel to the X-X' axis, and linked to it by means of at least one bridge (1.5), where there is a first cavity (C1) between the core (1.4) and the outer sleeve (1.1) accessible from the outside when the structural element is in the operating position on the mouth of the bottle; and a second cavity (C2) accessible from the inside, the first cavity (C1) and the second (C2) cavity are communicated by means of one or more windows (1.6), located between the core (1.4) and the outer sleeve (1.1), intended for the passage of the liquid stored in the bottle when the structural element is in the operating position on the mouth of the bottle; and, a second component (2) which can be removed by the user so that the structural element operates in nominal conditions comprising:

a first body (2.1) arranged in the first cavity (C1), a gripping element (2.2) accessible from the outside in an operating position attached to the first body (2.1), an element (2.3) of the first body (2.1) having a mechanical link or attachment with the first component (1) and is suitable so that after the second component (2) is removed by the user by means of pulling on the gripping element (2.2), this mechanical link or attachment stops acting.

2. The structural element according to claim 1, characterised in that the core (1.4) of the first component (1) has a perimetric ring (1.7) limiting the separating space between the first cavity (C1) and the second cavity (C2) and where the first body (2.1) of the second component (2) rests at least partially.

3. The structural element according to claim 1, characterised in that the element (2.3) of the first body (2.1) having a mechanical link or an attachment with the first component (1) is located in the second cavity (C2).

4. The structural element according to claim 1, characterised in that the element (2.3) of the first body (2.1) arranged in the second cavity (C2) comprises a step resting on at least one sector of the perimetric edge of a ring (1.7).

5. The structural element according to claim 2, characterised in that the element (2.3) of the first body (2.1) arranged in the second cavity (C2) is a prolongation extending, at least in one sector, perimetrically along the side of the ring (1.7) arranged in the second cavity (C2).

6. The structural element according to claim 2, characterised in that the core (1.4) has a housing for a valve arranged internally in the operating position and in that the element (2.3) of the first body (2.1) arranged in the second cavity (C2) is a prolongation extending, at least in one sector, through the inside of the housing of the core (1.4) for limiting the movement of one or more components of the valve.

7. The structural element according to claim 6, characterised in that the element (2.3) of the first body (2.1) extending, at least in one sector, through the inside of the housing of the core (1.4) comprises a weakening element (2.3.1) suitable for breaking when the second component (2) is removed.

8. The structural element according to claim 7, characterised in that the element (2.3) of the first body (2.1) has a sector which detaches inside the bottle after the weakening element (2.3.1) breaks.

9. The structural element according to claim 1, characterised in that the attachment between the first component (1) and the second component (2) is by means of bi-injection or by means of over injection.

10. The structural element according to claim 1, characterised in that the first component (1) and the second component (2) have different colours.

11. The structural element according to claim 1, characterised in that an end opposite the base (1.2) has a pouring surface (1.3) for pouring the liquid out of the bottle such that the structural element has the function of a pouring dispenser.

12. The structural element according to claim 1, characterised in that the base (1.2) is suitable for being located directly on the bottle such that the structural element has the function of a frame.

13. The structural element according to claim 1, characterised in that the second component is attached to the first component (1) closing any communicating passage between the first cavity (C1) and the second cavity (C2).

14. A bottle closure comprising a structural element according to claim 1 and a cap (10).

15. The bottle closure according to claim 14, characterised in that the cap (10), at least in its surface corresponding to the area covering the zone of the core (1.4), the first cavity (C1) or both, is transparent allowing viewing the second component (2) or part of said component (2).

* * * * *